US007032602B2

(12) United States Patent
Chang

(10) Patent No.: US 7,032,602 B2
(45) Date of Patent: Apr. 25, 2006

(54) EXTENSION HAIR HAVING GUIDE LOOP

(76) Inventor: In-Young Chang, 1479-110, Seocho-3dong, Seocho-gu, 137-073 Seoul (KR)

( * ) Notice: Subject to any disclaimer, the term of this patent is extended or adjusted under 35 U.S.C. 154(b) by 203 days.

(21) Appl. No.: 10/490,460

(22) PCT Filed: Nov. 10, 2003

(86) PCT No.: PCT/KR03/02403

§ 371 (c)(1),
(2), (4) Date: Mar. 23, 2004

(87) PCT Pub. No.: WO2005/006898

PCT Pub. Date: Jan. 27, 2005

(65) Prior Publication Data

US 2005/0011530 A1 Jan. 20, 2005

(30) Foreign Application Priority Data

Jul. 16, 2003 (KR) ..... 20-2003-0023059

(51) Int. Cl.
*A41G 3/00* (2006.01)
*A41G 5/00* (2006.01)

(52) U.S. Cl. ..... 132/53; 132/201

(58) Field of Classification Search ..... 132/53, 132/201, 54, 55, 56
See application file for complete search history.

(56) References Cited

U.S. PATENT DOCUMENTS

| | | | | |
|---|---|---|---|---|
| 4,307,908 | A * | 12/1981 | Donaldson | 132/200 |
| 5,121,761 | A * | 6/1992 | Meister | 132/201 |
| 2005/0098190 | A1* | 5/2005 | Kim | 132/201 |

FOREIGN PATENT DOCUMENTS

| | | |
|---|---|---|
| JP | 02-307903 | 12/1990 |
| JP | 07-118907 | 5/1995 |
| KR | 2002-0081205 A | 10/2002 |
| KR | 20-0316019 | 5/2003 |

* cited by examiner

*Primary Examiner*—John J. Wilson
*Assistant Examiner*—Robyn Doan
(74) *Attorney, Agent, or Firm*—Collard & Roe, P.C.

(57) ABSTRACT

The present invention relates to extension hair used to stage thin or short hair long. An upper inserting part of an flexible wire-form hair guiding loop, in which a hanging part is formed in the middle part and an inserting part and a drawing-out part are formed in the upper part, is inserted from the lower part to the upper part of the hair connecting tube so that the inserting part is exposed toward the upper part of the hair connecting tube. Separating freely from the hair connecting tube and drawing it down to the lower part of the hair connecting tube by the lower drawing-out part, it is possible for anybody skilled or not skilled to insert the hair into the hair connecting tube by a simple operation without an extra hair-guiding hook. Thanks to this, it is possible to simplify the working process and shorten the working time, prevent bodily wounds due to carelessness of the user and the loss of the hair guiding loop as the flexible circular inserting part and the lower hanging part prevent the hair guiding loop from separating freely from the hair connecting tube.

4 Claims, 8 Drawing Sheets

EXTENSION HAIR HAVING GUIDE LOOP

CROSS REFERENCE TO RELATED APPLICATIONS

Applicant claims priority under 35 U.S.C. §119 of Korean Application No. UM 2003-23059 filed Jul. 16, 2003. Applicant also claims priority under 35 U.S.C. §365 of PCT/KR03/02403 filed Nov. 10, 2003. The international application under PCT article 21(2) was not published in English.

TECHNICAL FIELD

The present invention relates to an extension hair having a hair guiding loop which is used to style thinning or short hair long. More particularly, the present invention relates to an extension hair having a hair guiding loop which allows a user's hair to be inserted into a hair connecting tube of artificial hair conveniently and rapidly by the hair guiding loop inserted into the hair connecting tube upon coupling the hair to the hair connecting tube of the artificial hair.

BACKGROUND ART

Recently, as women have been becoming keenly interested in their appearance and beauty, various accessories and stuffs are being developed. Especially, in case of hair, hair styles having unique individualities by various color changes, such as coloring, as well as a variety of hairstyling techniques, are often used as means for exhibiting one's individuality.

Particularly, in recent years, partial wigs using original hair are acquiring a greater vogue than hairstyling or coloring, for instance, short hair is made long utilizing various kinds or partial wigs, or bridge type partial wigs of a pre-colored state are utilized.

As mentioned above, in case of making short hair long, an extension hair made of human hair or artificial hair is used. If it is desired to connect such an extension hair to a user's hair, a predetermined number of the extension hair is taken out, an adhesive is applied to the end of the extension hair, and then the extension hair is attached to the end of hair desired to be connected, by which the extension hair is connected as the adhesive is completely hardened.

Further, the adhesive is solidified in such a manner that a liquid adhesive melted by a super-heat is coated, with the extension hair end and the user's hair end being overlapped each other, and then as the liquid adhesive starts to be hardened, a hairdresser makes a roll of the liquid adhesive directly with fingers to form it round and solidify it.

However, in such a typical extension hair above-stated, in case of a extension hair not processed at all, a certain amount of the extension hair is taken out of a strand of hair. Thus there are a lot of hair dropping on the floor or falling here and there during use, so it is not economical. Moreover, also the number of the hairs is not constant, this makes it difficult to expect a beauty state of a high quality. Especially, in a case that the user's hair and the extension hair are connected using a liquid adhesive injecting device, the applied amount of the liquid adhesive is not constant thus the adhesion size is not constant as well as the operation is so messy.

Upon coating and forming the liquid adhesive on the end of the certain amount of the extension hair, a super-heat is directly applied to the user's hair in order to melt the hardened adhesive, so this may lead to the damage to the hair as well as the risk of burning. In addition, the melted adhesive flows down or makes the operation messy, thereby failing in attaining a simple and tidy connection.

To overcome the above-described problem, the present applicant had registered an extension hair in Korean Utility Model Registration No. 316019, which can attain a firm fixation is attained without any after-treatment and hardening treatment by applying an adhesive to the end of human hair or artificial hair divided into a predetermined number and inserting, attaching and fixing the applied adhesive and the end of the human hair or artificial hair into a hair connecting tube made of a moisture-resistant shrinkable tube of a predetermined length, whereby, if the outside of the hair guiding tube is heated with the end of the user's hair to be connected being inserted into the hair guiding tube, the adhesive inside is coupled to the user's hair while being melted and the hair guiding tube is firmly fixed to the user's tube while being shrunken.

At this time, in order to insert the above-described hair to the hair connecting tube, there is employed the method in which a jig such as a hook for use in hair guiding is pushed down through the inside of the hair connecting tube, and the hair on the scalp is hooked on the hook to be pulled out of under the tube body.

However, the above-stated hair insertion method has problems that it may lead to the troublesomeness of work due to several work processes during work and resultantly lead to the delaying of work time, and it may bring on an injury to a human body through carelessness in the use of the hook.

That is to say, as the jig for drawing out hair, a needle for knitting or a hook or the like is utilized. In case that an extension work is carried out utilizing the jig, there is a problem that an extension hair is entangled or broken. In case of an extension hair having a hair connecting tube with a relatively small inner diameter, there is a problem that it is difficult to insert the jig into the connecting tube and a lot of defective items are generated in this insertion procedure.

Further, there may occur a problem that work cannot be carried out if the hook is lost from carelessness in keeping the hook for hair guiding.

DISCLOSURE OF INVENTION

The present invention has been developed for the purpose of solving the foregoing problems and thus it is an object of the present invention to provide an extension hair having a hair guiding loop, in which the hair guiding loop of an flexible wire-form is provided with a hanging part on the middle part, an inserting part on the upper part and a drawing-out part on the lower part, the upper inserting part being inserted from the lower part to the upper part of the hair connecting tube so that the inserting part is exposed toward the upper part of the hair connecting tube, and which makes it possible for anybody skilled or not skilled to insert the hair into the hair connecting tube by a simple operation without an extra hair guiding hook, accordingly simplifies the working process and shorten the working time, prevents bodily wounds due to carelessness of the user, and prevents the loss of the hair guiding loop as the flexible circular inserting part and the hanging part on the lower part prevent the hair guiding loop from separated freely from the hair connecting tube.

BRIEF DESCRIPTION OF THE DRAWINGS

These and other features, aspects, and advantages of preferred embodiments of the present invention will be more fully described in the following detailed description, taken accompanying drawings. In the drawings:

FIGS. 3*a* through 3*c* are cross-sectional views showing a used state of a guiding loop according to the present invention, wherein FIG. 3*a* is a cross-sectional view of hair before use when inserted into the guiding loop, FIG. 3*b* is a cross-sectional view of the hair when inserted into the hair connecting tube of the extension hair and FIG. 3*c* is a cross-sectional view of the user's hair and the extension hair when connected by the hair connecting tube;

Figure 1:
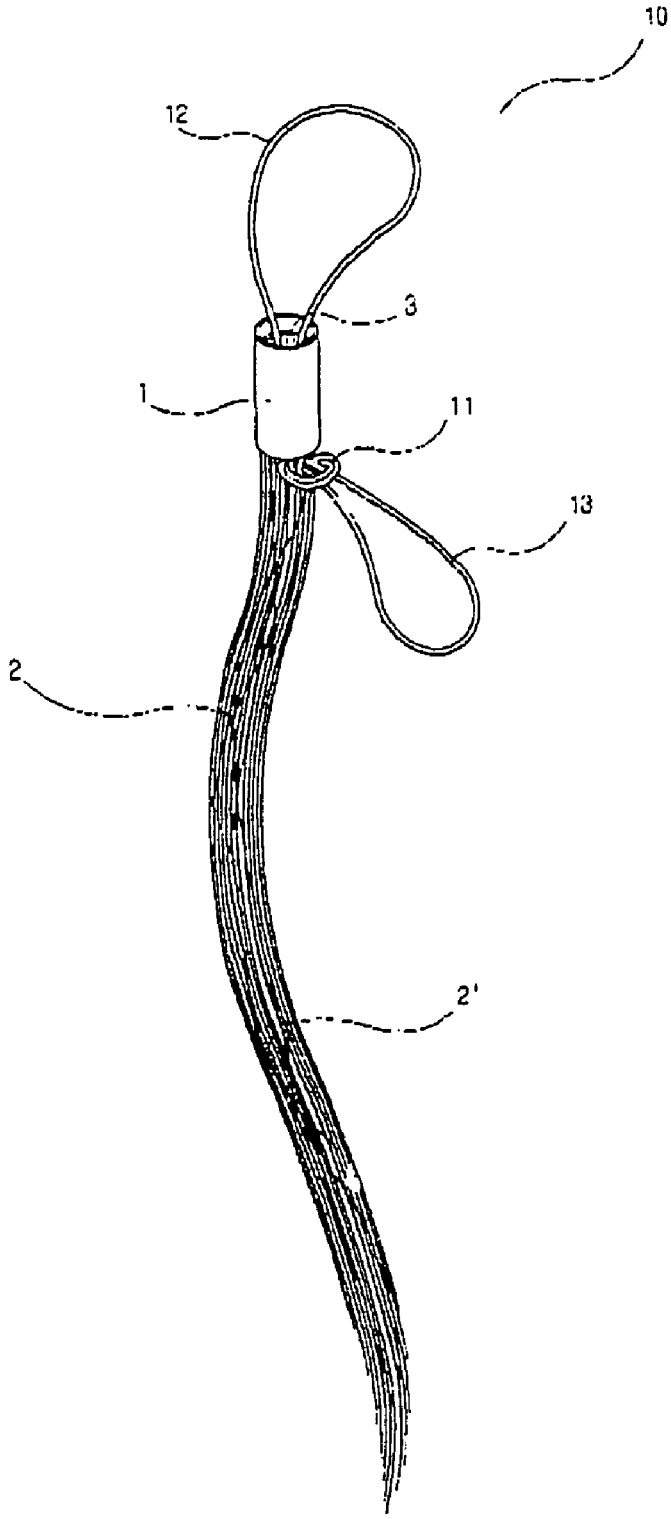
FIG. 1 is an overall perspective view of an extension hair according to the present invention.

Explanation of the Reference Numerals for the Main Parts of the Drawings

| | |
|---|---|
| 1: | hair connecting tube |
| 2,2': | supplemental hair |
| 3: | adhesive |
| 10: | hair guiding loop |
| 11: | hanging part |
| 12: | inserting part |
| 13: | drawing-out part |

BEST MODES FOR CARRYING OUT THE INVENTION

Hereinafter, a preferred embodiment of the present invention will now be described in detail with reference to the accompanying drawings.

Figure 2:
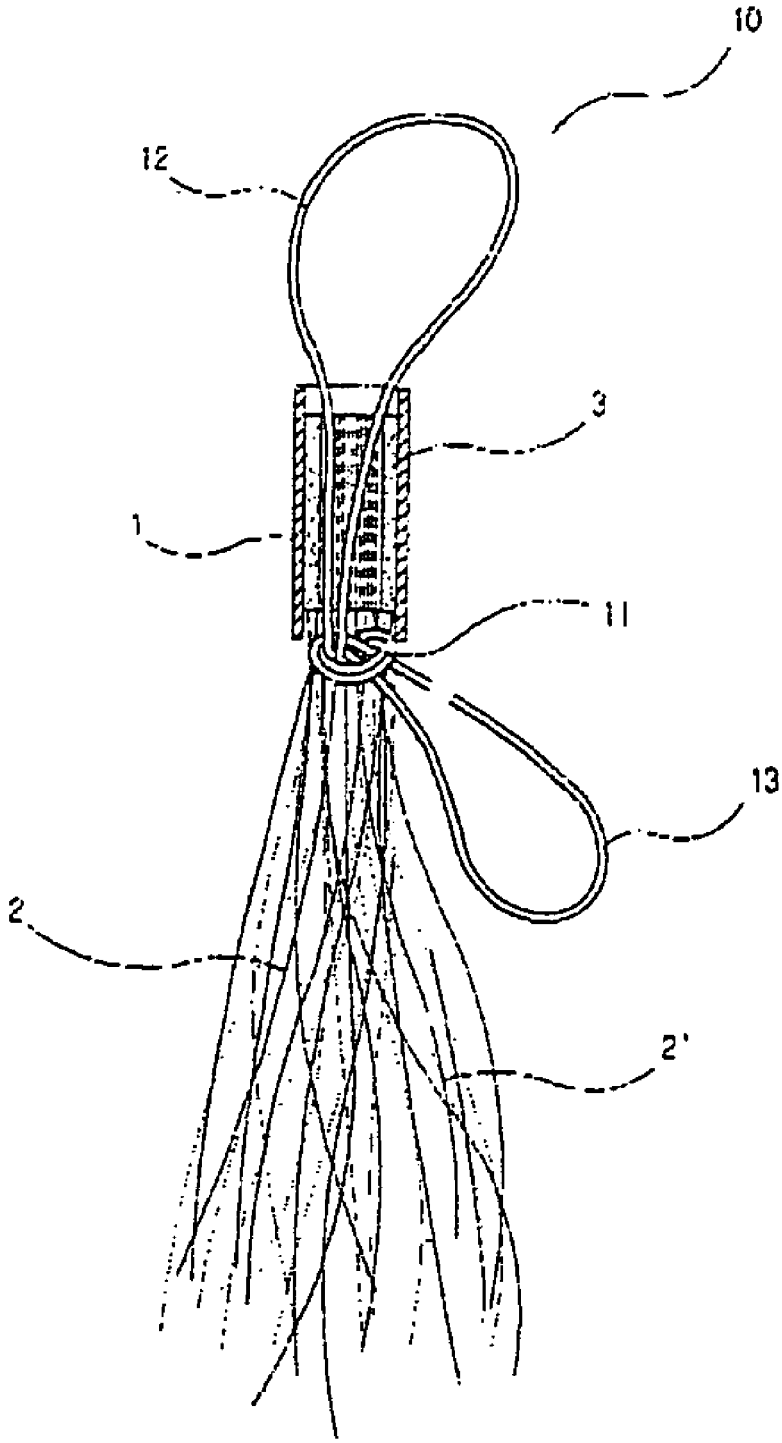
FIG. 2 is an enlarged cross-sectional view illustrating a hair connecting tube of the extension hair according to the present invention.
Figure 5:
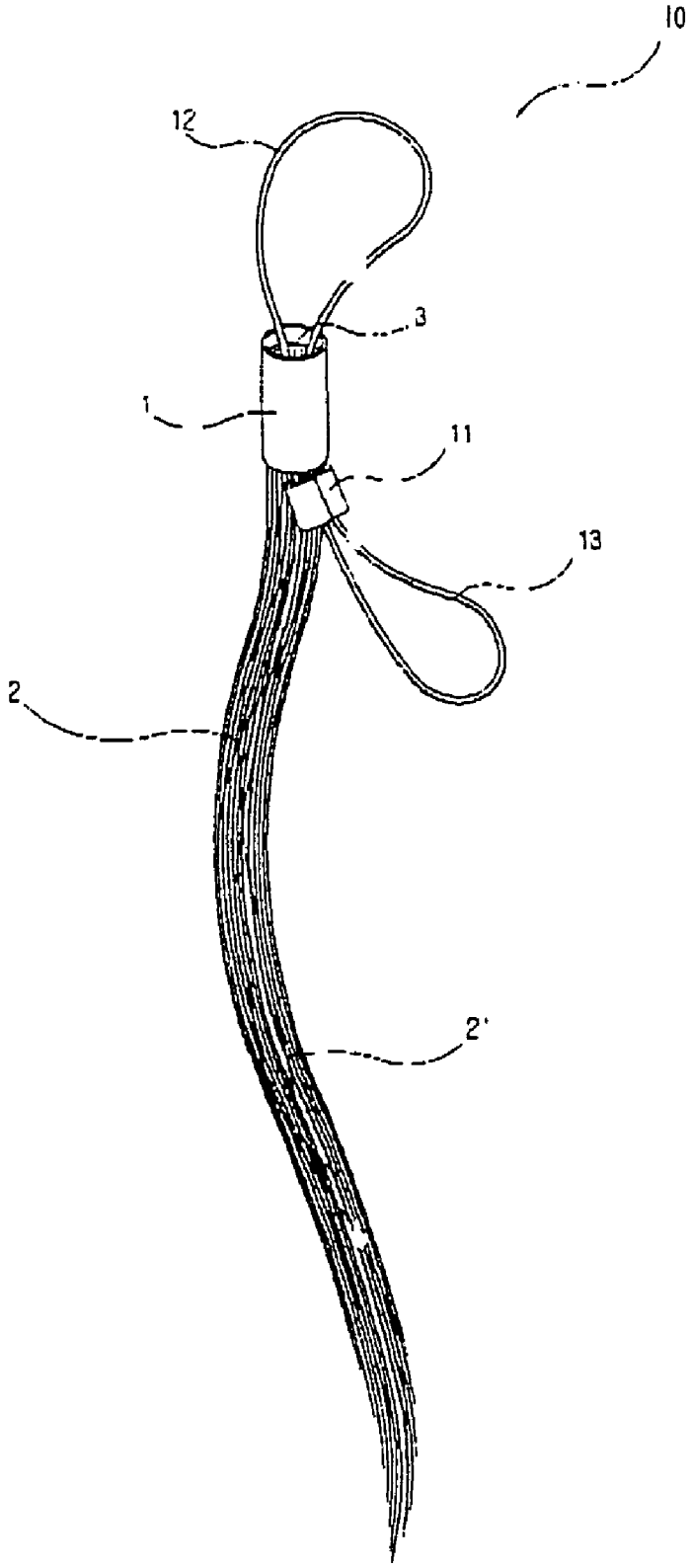
FIG. 5 is a view of a guiding loop according to another embodiment of the present invention.
Figure 6:
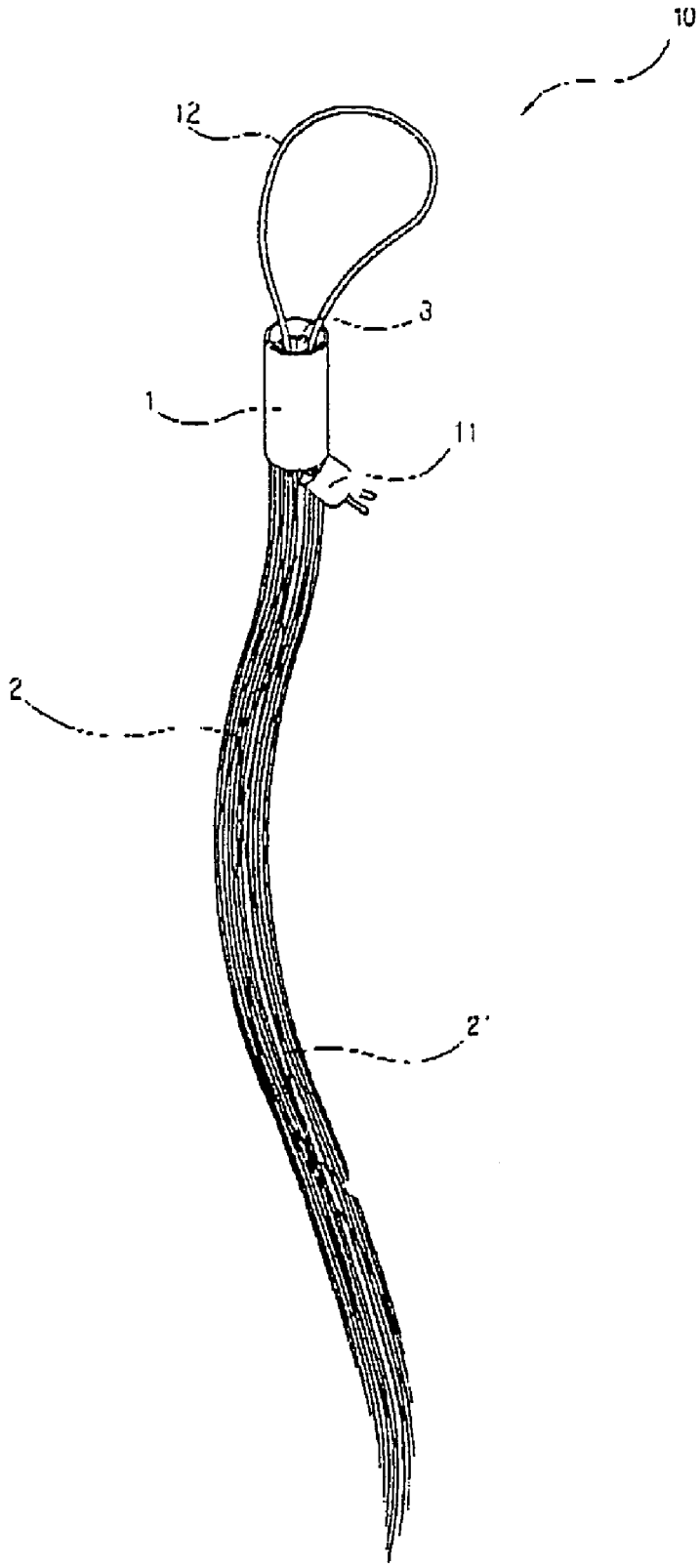
FIG. 6 is a view of a guiding loop according to still another embodiment of the present invention.

FIG. 1 is an overall perspective view of an extension hair according to the present invention, FIG. 2 is an enlarged cross-sectional view illustrating a hair connecting tube of the extension hair according to the present invention, FIG. 5 is a view of a guiding loop according to another embodiment of the present invention, and FIG. 6 is a view of a guiding loop according to still another embodiment of the present invention.

A known extension hair having a hair guiding loop, which is made by adhering the ends of a plurality of supplemental hairs 2 and 2' to the inner circumferential surface of a hair connecting tube 1 of a predetermined length by an adhesive 3, wherein the hair guiding loop 10 has a hanging part 11 is formed on the middle part and an inserting part 12 and a drawing-out part 13 are formed in a circular shape respectively on the upper part of and on the lower part, the hanging part 11 of the hair guiding loop 10 being located at the lower part of the hair connecting tube 1 and the inserting part 12 being inserted in a manner to be exposed to the upper part of the hair connecting tube 1 in an flexible circular shape.

The hanging part 11 of the hair guiding loop 10 is formed by knotting, or is formed of a compressed member or a shrinkable member.

Further, the hair guiding loop 10 is provided with the circular inserting part 12 on the upper part and the hanging part 11 done on the lower part.

In the drawings, unexplained reference number 20 is hair.

By the above configuration, the operation and used state of the extension hair according to the present invention will now be described in more detail with reference to the accompanying drawings.

As shown in FIGS. 1 and 2, the present invention has a structure in which the inserting part 12 of the hair guiding loop 10 is inserted from the lower part to the upper part in the hair connecting tube 1 of the extension hair.

The hair guiding loop 10 is in a wire-form having a predetermined flexibility, such as a fishing line, and is inserted to the hair connecting tube 1 of each of the extension hair.

As the hair connecting tube 1, a moisture resistant shrinkable tube active by heat or a metal tube compressive by an external pressure or the like is preferably used.

The hair guiding loop 10 inserted into the hair connecting tube 1 of each of the extension hair is formed by knotting on the lower part, or hung on the lower part of the hair connecting tube 1 by the hanging part 11 formed of a compressed member or a shrinkable member. The inserting part 12 inserted to be exposed to the upper part has flexibility, keeps a circular loop shape and is flexibly supported on the upper part of the hair connecting tube 1, thereby preventing the hair guiding loop 10 from being separated from the hair connecting tube 1 unless there is an external force upon handling the extension hair.

Figure 3A:
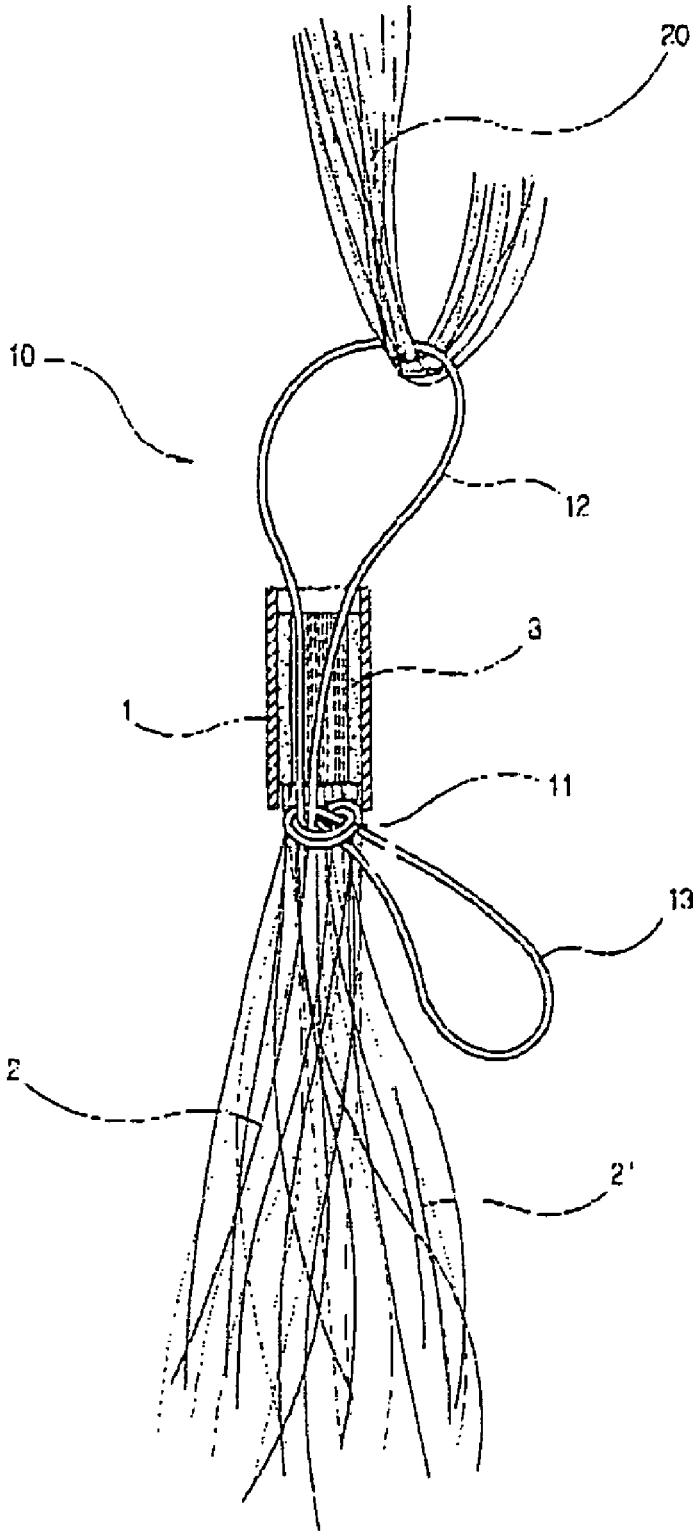

In a case that such extension hair having the hair guiding loop is connected to a user's hair, firstly, as shown in FIG. 3*a,* a predetermined number of the user's hair 20 to be connected to the extension hair is inserted into the inserting part 12 of a circular loop shape inserted in a manner to be exposed to the upper part of the hair connecting tube 1 of the extension hair.

Figure 3B:
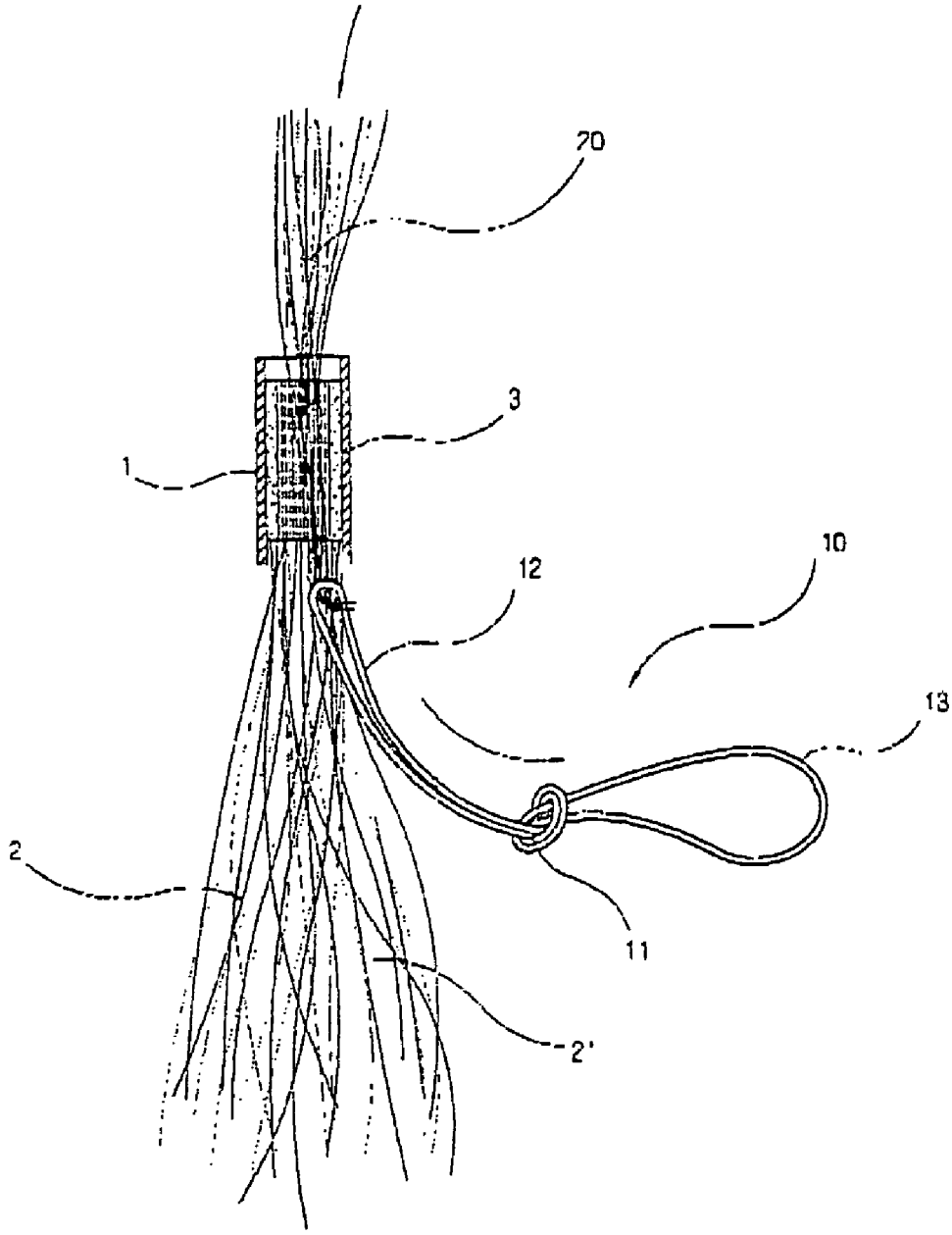

With the user's hair 20 being hung on the inserting part 12 of the hair guiding loop 10, as shown in FIG. 3*b,* the hairdresser holds the drawing-out part 13 formed on the lower part of the hair guiding loop 10 and pulls the hair guiding loop 10 down to the lower part of the hair connecting tube 1. Then, the inserting part 12 on which the user's hair 20 is hung is separate to the lower part through the inside of the hair connecting tube 1 by means of the pulling force of the drawing-out part 13.

The inserting part 12 is changed in shape by an artificial force upon passing through the hair connecting tube 1 and is separated to the lower part through the inside of the hair connecting tube 1. That is, the user's hair 20 hung on the inserting part 12 is prevented from separation owing to the compression force of the hair connecting tube 12. When the hair guiding loop 10 separated to the lower part of the hair connecting tube 1 is completely separated from the hair connecting tube 1, the user's hair 20 drawn down by the inserting part 12 is inserted into the hair connecting tube 1 and overlapped with the supplemental hairs 2 and 2' of the extension hair.

Figure 3C:
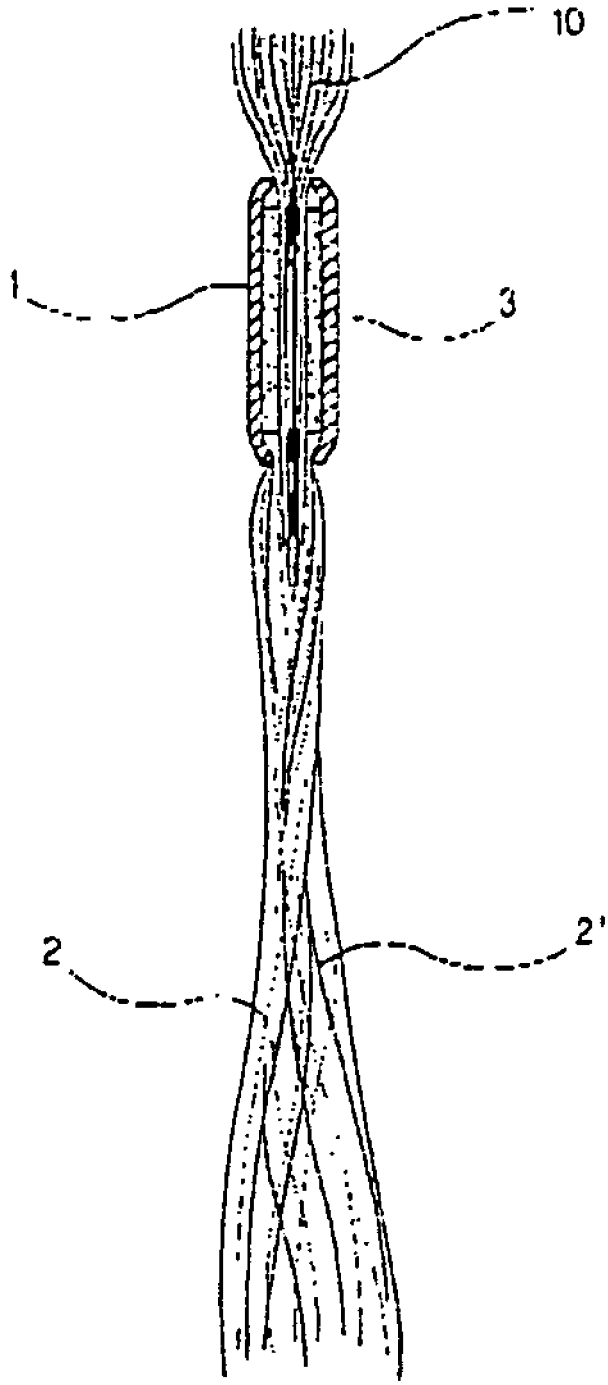

On the other hand, upon connecting and fixing the user's hair 20 and the supplemental hairs 2 and 2' overlapped in the hair connecting tube 1, in case of using the hair connecting tube 1 made of an moisture resistant shrinkable tube as shown in FIG. 3*c,* when the outer part of the hair connecting tube 1 is heated by heat, the hair connecting tube 1 is shrunken as the adhesive 3 in the hair connecting tube 1 as melted by the heat, and the diameter of the hair connecting tube 1 is sharply decreased.

Thus, by the shrinkage phenomenon of the hair connecting tube 1, the inner space of the adhesive 3 which the user's hair 20 is inserted into becomes smaller and the user's hair 20 is fixed. At the same time, the adhesive 3 melting by heat makes the user's hair 20 and the supplemental hairs 2 and 2' mixed with and adhered to each other. When the heat source is removed, the supplemental hairs 2 and 2; and the user's hair 20 are firmly fixed by the adhesive 3 therein as the adhesive 3 is hardened.

Further, in case of using the hair connecting tube 1 made of a compression type metal tube, when a pressure is applied to the outer part of the hair connecting tube 1 by a press, the hair connecting tube 1 is compressed by the compression force. By the compression of the hair connecting tube 1, the inner space of the hair connecting tube 1 in which the user's hair 20 is inserted becomes also smaller and the user's hair 20 is fixed. At the same time, by the flexible force of the adhesive 3 inside the hair connecting tube 1 where hair is planted, the user's hair 20 and the supplemental hairs 2 and 2' becomes to have a greater compression force, thereby preventing depilation. Moreover, the hair is not directly contacted to the metal surface of the hair connecting tube 1 after compression, thereby preventing the adverse effects such as hair fracturing or cutting.

On the other hand, as shown in FIG. 6, the hair guiding loop 10 utilized as described above can be simplified by forming the inserting part 12 of a circular shape on the upper part and alone the hanging part 11 on the lower part. Upon separating the hair guiding loop 10, when the hair guiding loop 10 is pulled down to the lower part of the hair connecting tube 1, the inserting part 12 on which the user's hair 20 is hung is separated to the lower part through the inside of the hair connecting tube 1 by the pulling power of the drawing-out part 13.

Figure 4:
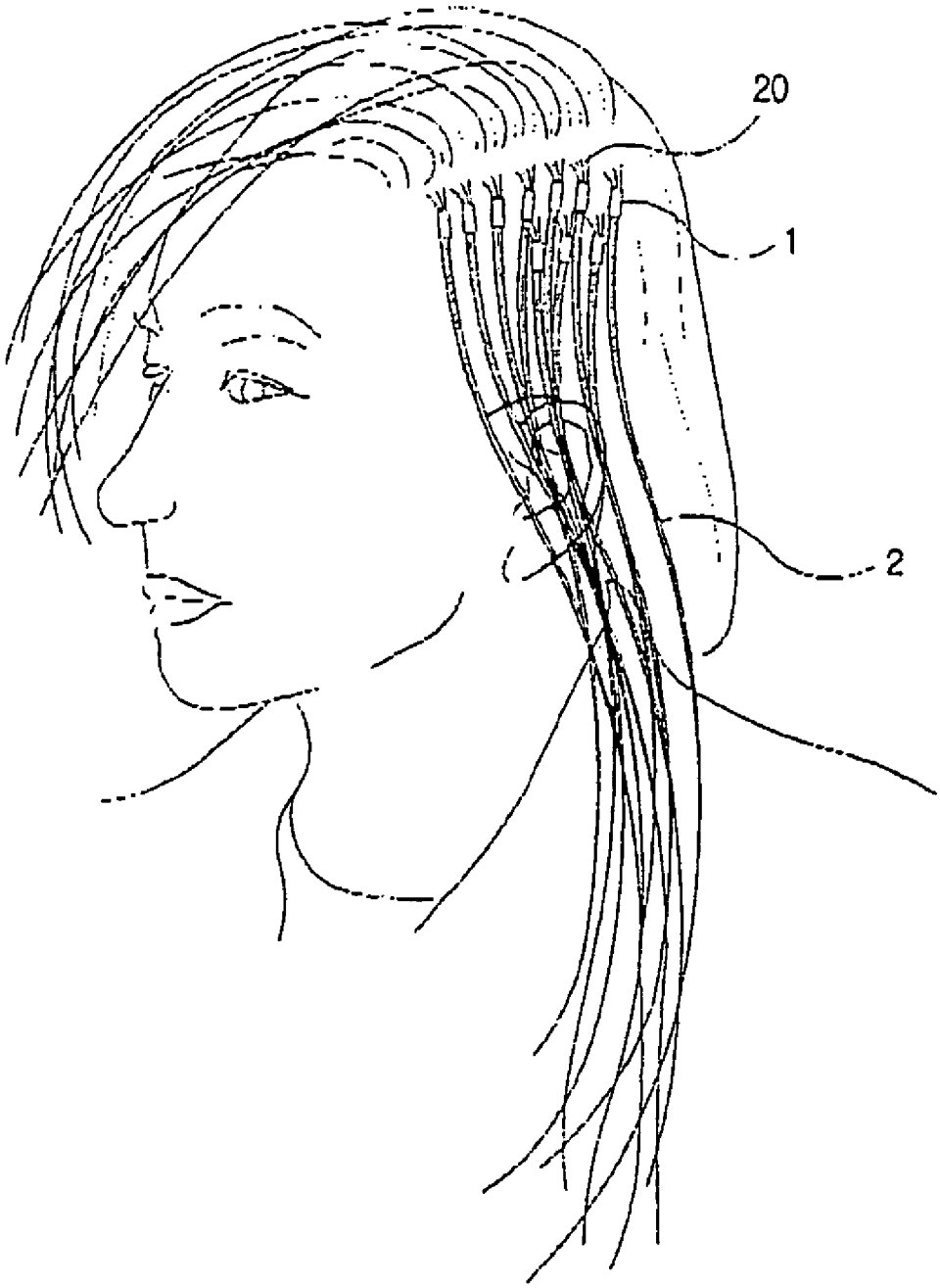
FIG. 4 is a used state view of the extension hair of the present invention when connected to the user's hair.

Using the extension hair of this type, as shown in FIG. 4, the end of the user's hair 20 can be inserted into the hair connecting tube 1 if it is desired to make short hair long or create a variety of hair styles such as bridging, thus an extension hair connection work can be achieved conveniently and rapidly.

INDUSTRIAL APPLICABILITY

As described above, the present invention is possible for anybody skilled or not skilled to insert the hair into the hair connecting tube by a simple operation without an extra hair guiding hook. Thanks to this, it is possible to simplify the working process and shorten the working time, prevent bodily wounds due to carelessness of the user, and prevent the loss of the hair guiding loop as the flexible circular inserting part and the hanging part on the lower part prevent the hair guiding loop from separated freely from the hair connecting tube.

The invention claimed is:

1. An extension hair having a hair guiding loop, which is made by adhering the ends of a plurality of supplemental hairs (2 and 2') to the inner circumferential surface of a hair connecting tube (1) of a predetermined length by an adhesive (3), wherein the hair guiding loop (10) has a hanging part (11) is formed on the middle part and an inserting part (12) and a drawing-out part (13) are formed in a circular shape respectively on the upper part and on the lower part of said hair connecting tube, the hanging part (11) of the hair guiding loop (10) being located at the lower part of the hair connecting tube (1) and the inserting part (12) being inserted in a manner to be exposed to the upper part of the hair connecting tube (1) in an flexible circular shape.

2. The extension hair of claim 1, wherein the hanging part (11) is formed by knotting.

3. The extension hair of claim 1, wherein the hanging part (11) is formed of a compressed member.

4. The extension hair of claim 1, wherein the hanging part (11) is formed of a shrinkable member.

* * * * *